US005842517A

United States Patent [19]

Coone

[11] Patent Number: 5,842,517

[45] Date of Patent: Dec. 1, 1998

[54] ANTI-ROTATIONAL CEMENTING APPARATUS

[75] Inventor: Malcolm G. Coone, Katy, Tex.

[73] Assignee: Davis-Lynch, Inc., Houston, Tex.

[21] Appl. No.: 850,528

[22] Filed: May 5, 1997

[51] Int. Cl.[6] ..... E21B 33/16

[52] U.S. Cl. ..... 166/156; 166/177.4

[58] Field of Search ..... 166/156, 177.4, 166/177.5, 154, 348

[56] References Cited

U.S. PATENT DOCUMENTS

| | | | |
|---|---|---|---|
| Re. 33,656 | 8/1991 | Wardlow, III et al. | 116/153 |
| 2,165,433 | 7/1939 | Wickersham . | |
| 3,550,383 | 12/1970 | Comeaux | 116/156 |
| 4,190,111 | 2/1980 | Davis | 116/291 |
| 4,190,112 | 2/1980 | Davis | 116/291 |
| 4,266,614 | 5/1981 | Fredd | 166/154 X |
| 4,669,541 | 6/1987 | Bissonnette | 166/154 |
| 4,711,300 | 12/1987 | Wardlow, III et al. | 116/153 |
| 4,836,279 | 6/1989 | Freeman | 116/153 |
| 4,858,687 | 8/1989 | Watson et al. | 116/153 |
| 5,025,858 | 6/1991 | Glaser | 116/156 |
| 5,026,097 | 6/1991 | Reimert | 166/348 X |
| 5,095,980 | 3/1992 | Watson | 166/153 X |
| 5,113,940 | 5/1992 | Glaser | 166/153 X |
| 5,234,052 | 8/1993 | Coone et al. | 116/155 |
| 5,246,069 | 9/1993 | Glaser | 166/153 X |
| 5,372,201 | 12/1994 | Milberger | 166/348 X |
| 5,390,736 | 2/1995 | Buddle | 116/153 |

*Primary Examiner*—Frank Tsay
*Attorney, Agent, or Firm*—Matthews, Joseph, Shaodox, Mason; Henry L. Ehrlich

[57] ABSTRACT

The apparatus of the present invention is a mechanism for use in cementing a casing string in a well bore comprising a float collar connectable to the casing string, a cement plug engagable to the float collar, and a wiper plug engagable to the cement plug, each element utilizing inclined plane J-slots for engagability. When engaged, the J-slots disallow not only rotational movement between the elements, but also vertical movement between the elements.

16 Claims, 5 Drawing Sheets

ANTI-ROTATIONAL CEMENTING APPARATUS

BACKGROUND OF THE INVENTION

This invention relates generally to apparatus for use in the drilling and completion of an oil and/or gas well. More particularly, it relates to an assembly of an interlocking float collar, cement plug, and wiper plug used when cementing a casing string within the bore of a well whereby the interlock prevents rotational and vertical movement between the float collar, cement plug, and wiper plug.

It is conventional practice, in the drilling and completion of such wells, to install a float collar in the casing string near its lower end. For this purpose, the collar comprises an outer body connectable as part of the drill string, an inner body having a bore therethrough, and a check valve member mounted in the bore to permit flow downwardly but prevent flow upwardly therethrough. Thus, the collar prevents the string from being filled with drilling fluid as it is "floated" into the well bore.

When the casing string has been lowered to the desired depth, a cement or bottom plug is pumped downwardly through the string by means of a slurry of cement and mud above it to seat on the float collar. For this purpose, the cement plug includes a body having lips or wipers about it to flexibly engage the inner diameter of the string and a bore therethrough having a frangible diaphragm across it.

With the cement plug seated on the float collar, the pressure of the cement is raised to a level to rupture the diaphragm. A wiper or top plug also including a body having lips or wings about it to flexibly engage the inner diameter of the string is installed in the string above the column of cement slurry and is then pumped downwardly by the pressure of drilling fluid above it so as to force the cement slurry out the lower end of the casing string and upwardly into the annulus between the string and well bore.

DESCRIPTION OF THE RELATED ART

The inner body of the float collar, as well as the bodies of the plugs are made of a drillable material which, when the slurry has set up to anchor the string in the well bore, may be drilled out along with the cement by a bit on the lower end of a rotary drill string, to establish a full opening through the string. Although conventional drilling bits having toothed cutting elements permit the equipment to be drilled out with relative ease, they have been difficult to drill out with more modern drilling bits made out of polycrystalline diamond compact (PDC). Thus, it has been suggested, as disclosed in U.S. Pat. Nos. Re. 33,656, 4,711,300, 4,836,279 and 4,858,687, that the upper end of the float collar and lower end of the cement plug and the upper end of the cement plug and the lower end of the wiper plug be provided with matching teeth or lugs intended to prevent relative rotation between them and thus facilitate removal of the drillable materials in response to the rotation of the bit.

Except for the weight imposed on the bit, however, the prior art does not discourage vertical vibrations on the equipment, especially since the bit itself will vibrate as it is drilling out the material. Consequently, the cutting operation is inefficient and time-consuming, and the interlocking elements are subject to excessive wear to the point of not deterring rotation.

U.S. Pat. No. 3,550,683 shows a plug of this type having arcuate teeth about its lower end adapted to fit within arcuate slots in the upper end of a float shoe, as the plug is landed on the shoe, and thus are intended to lock the plug against rotation with respect to the collar upon rotation of the bit. Moreover, grooves about the lower end of the plug are apparently intended to latch into matching grooves about the bore of the collar as the teeth are lowered into the slots. Obviously, however, the extent to which the grooves will hold the plug down and prevent its vibration depends on the tolerance between them, which in turn depends on the depth to which the arcuate teeth move downwardly into the slots.

U.S. Pat. No. 5,234,052 teaches a similar plug apparatus having threads as the means for limiting the rotation between the collar and the plugs. While this invention provides a greater degree of protection against rotation in that vertical movement is prohibited, the make up of the threads may be inhibited by cement or debris. Additionally, rotation is required to make up the threads.

It is therefore the primary object of this invention to provide such an assembly in which the cement and wiper plugs, or, in the absence of the cement plug, the wiper plug, are more securely held against rotational and vertical movement, while at the same time providing a greater probability and ease of make up to one another. Other objects include: providing make up without the need to rotate either plug, construction of a sealed channel through the cement plug and float collar so that mud or cement pumped therethrough enters the annulus; reduced production costs for the float collar, cement plug, and wiper plug; high rotational shear strength between the float collar and cement plug and the cement plug and wiper plug; and an efficiently drillable cementing apparatus.

BRIEF DESCRIPTION OF THE DRAWINGS

In the drawings, wherein like reference characters are used throughout to designate like parts.

DESCRIPTION OF THE PREFERRED EMBODIMENT

Figure 1:
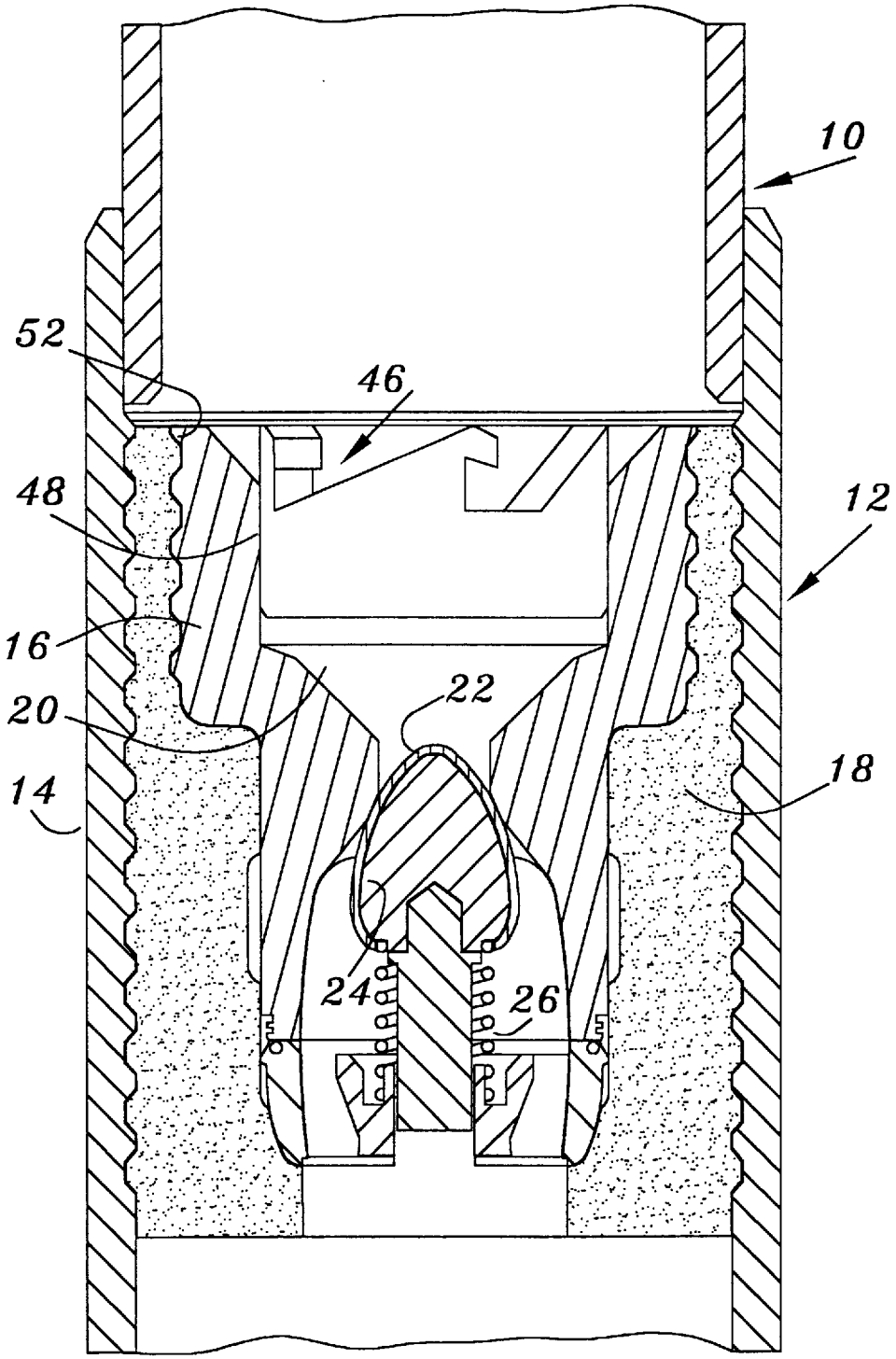
FIG. 1 is a cross-sectional view of a casing string, interrupted along its length, and having a float collar installed therein.
Figure 2:
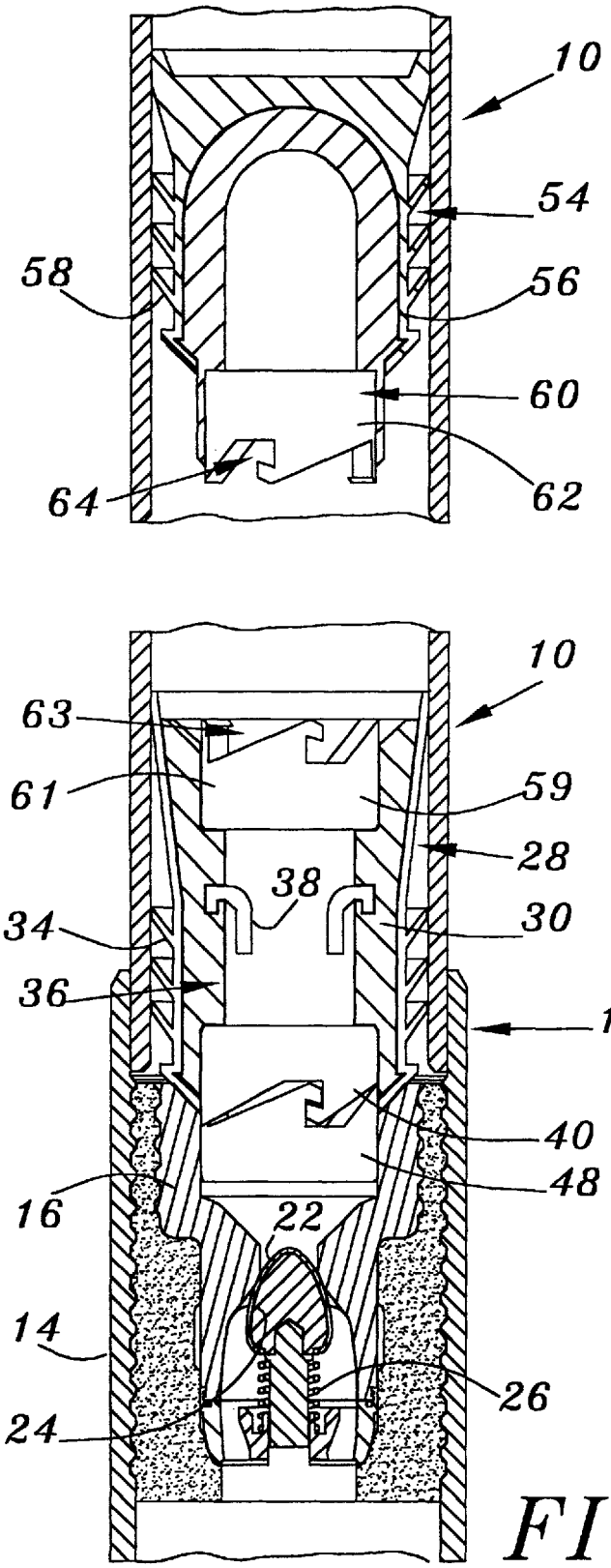
FIG. 2 is a cross-sectional view of a casing string, interrupted along its length, and having a float collar and cement plug interlocked and installed therein and a wiper plug thereabove.
Figure 3:
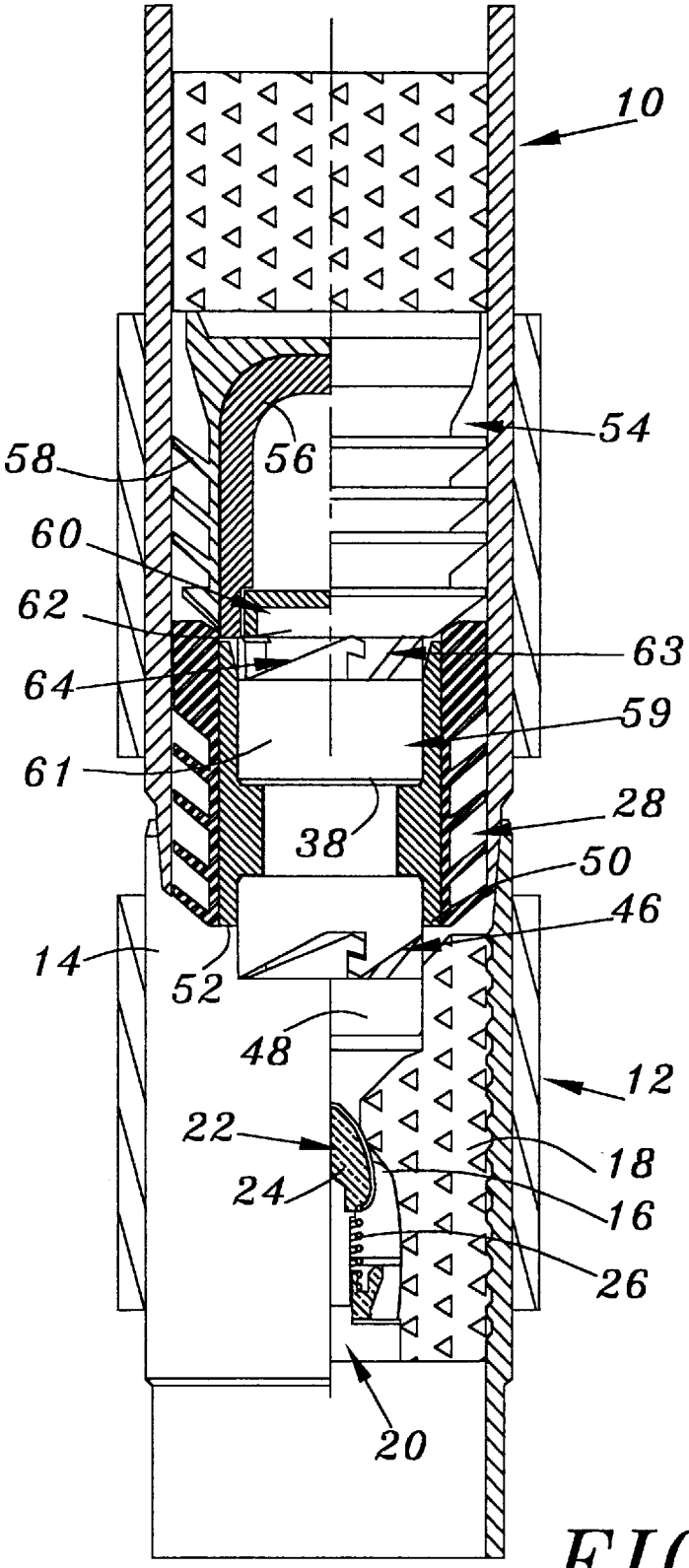
FIG. 3 is a partially cross-sectional view of a casing string, interrupted along its length, and having a float collar, cement plug, and wiper plug interlocked and installed therein.

With reference now to the details of the above described drawings, the casing string, indicated in part in each of FIGS. 1, 2, and 3 by reference character 10, is shown to be lowered into the desired depth in the well bore. The float collar constructed in accordance with the present invention, and illustrated in its entirety by reference character 12, includes an outer tubular body 14 threadedly connected at is upper end to the lower end of a joint of the casing string 10 near its lower end. Although not shown, it will be understood that the lower end of the body 14 would in turn be threadedly connected to another joint of the casing string.

The float collar 12, shown connected to casing string 10 in FIG. 1, also includes an inner body 16 anchored within outer body 14 by a short column of cement 18, and having a bore 20 therethrough connecting its upper and lower ends. The bore is adapted to be opened and closed by means of a check valve 22 comprising a poppet-type valve member 24 adapted to be moved vertically between a lower position opening bore 20 and an upper position closing bore 20, thus permitting flow downwardly therethrough, but preventing flow upwardly therethrough. As shown, in the preferred embodiment, poppet 24 is yieldably urged to its upper position by means of a coil spring 26, however other means can also be used for this purpose, such as a compressed gas or air cylinder or an arched spring.

Figure 4:
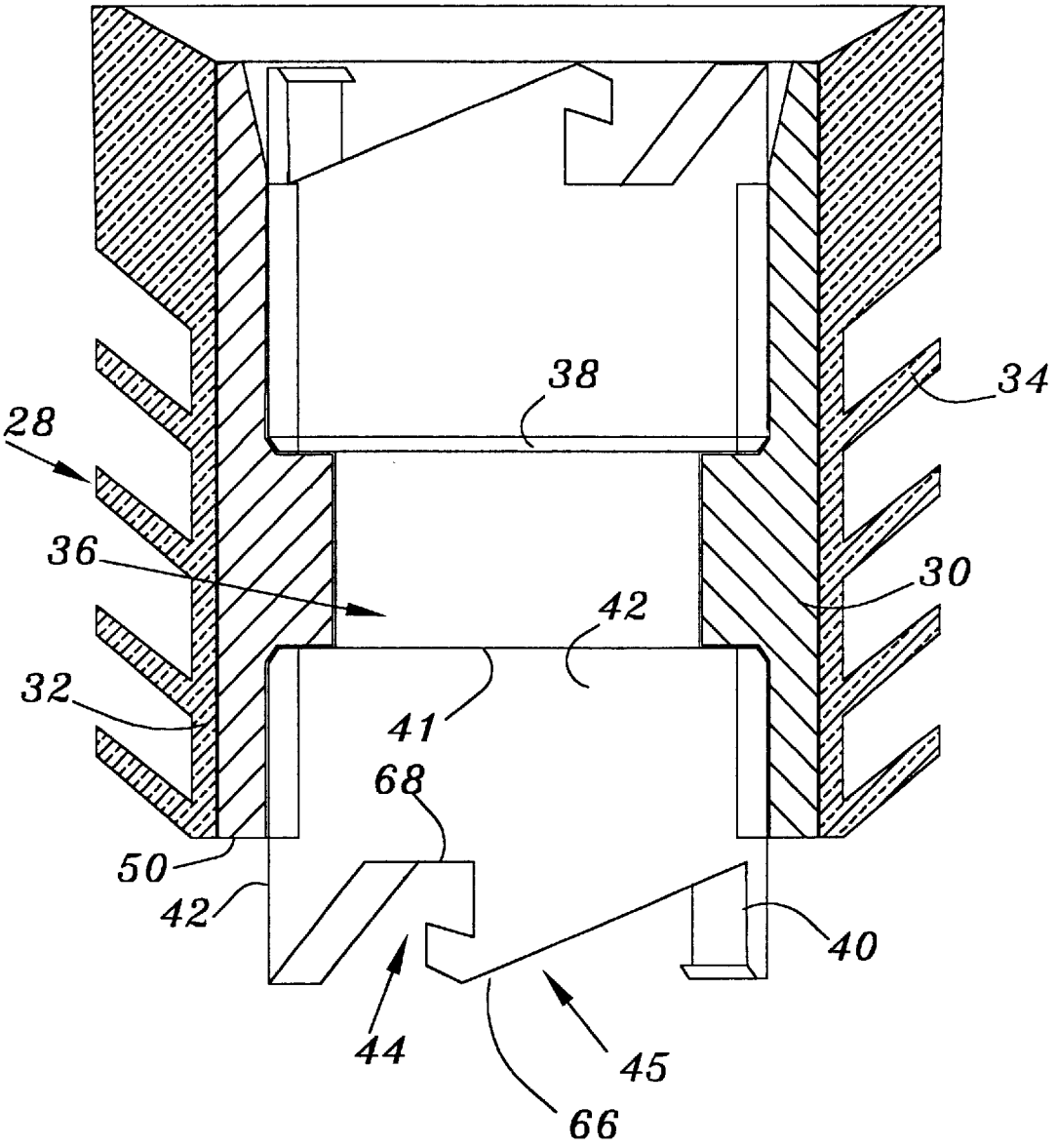
FIG. 4 is a cross-sectional view of the cement plug.
Figure 5:
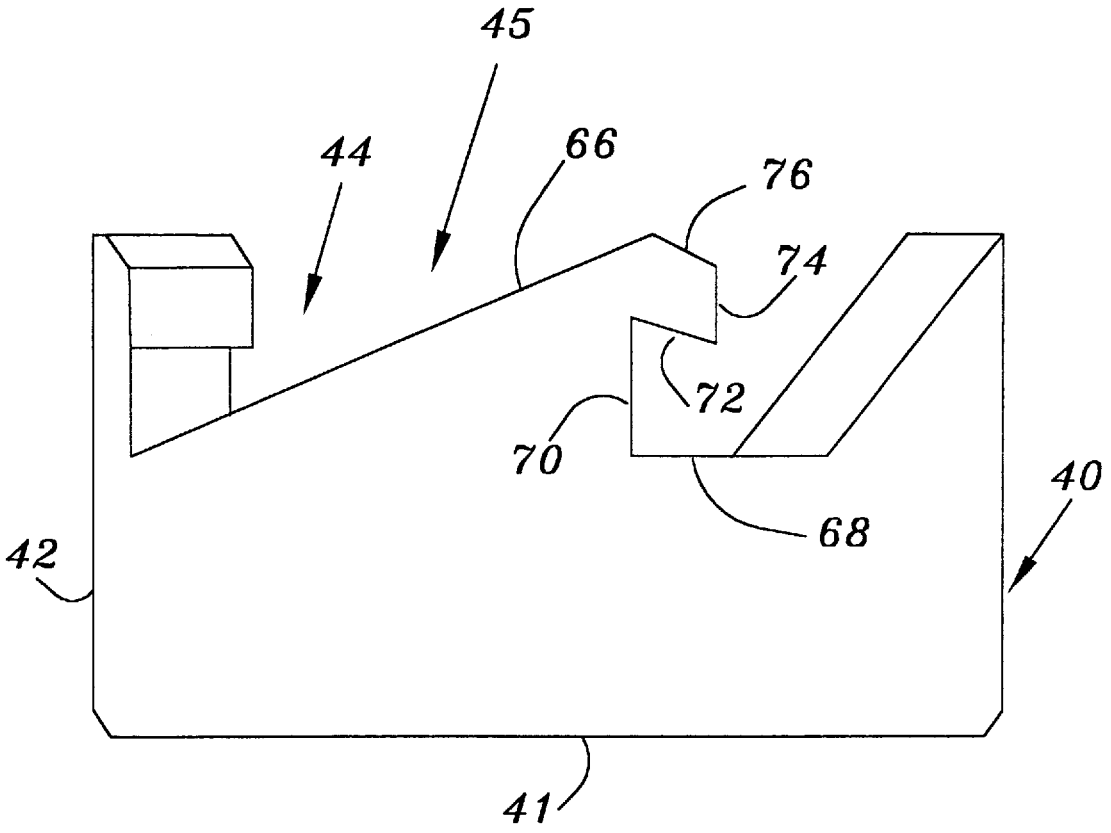
FIG. 5 is a side view of the anti-rotational locking member of the lower end of the cement plug illustrated in FIG. 4.

The cement or lower plug, indicated in its entirety by reference character 28, and shown in FIGS. 2, 3, and 4, includes a tubular body 30 and a sleeve 32 of elastomeric material about the body having annular lips or wings 34 thereabout which are adapted to flexibly engage the inner diameter of the casing string 10 to permit the plug 28 to be pumped downwardly therein in response to fluid pressure above it. Body 30 also has a bore 36 therethrough and a frangible or rupturable diaphragm 38 thereacross.

In accordance with the novel aspects of the present invention, a first anti-rotational locking member 40, shown in FIGS. 1, 2, 3, 4, and 5, has an attachable face 41 which is attachable to the tubular body 30. Though attachment may be accomplished by several means, including without limitation epoxy, threads, slots, direct molding, the preferred method is by epoxy. The first anti-rotational locking member 40 is comprised of a cylinder 42 having one or more, and preferably four, inclined plane J-slots 44 cut or molded therein on a lockable end 45, which is opposite attachable face 41. The inclined plane J-slots 44 are indentations in the circumference of the cylinder 42 each having an incline 66 adjacent to a surface 68 which is parallel to the attachable face 41, adjacent to a perpendicular surface 70, adjacent to a reversed incline 72, a second perpendicular surface 74, and a second reversed incline 76. The inclined plane J-slots 44 are cut, molded, and/or positioned in such a manner as to allow mating with a similar inclined plane J-slots 46 on a second anti-rotational locking member 48, similar to first anti-rotational member 40, and attachable to the top end of the float collar 12. In the preferred embodiment of this device, the first anti-rotational locking member 40 is identical to the second anti-rotational locking member 48, so that a single mold or production process may produce each anti-rotational locking member, providing a cost benefit.

As hooks on the inclined plane J-slots 44, 46 engage, a shoulder 50 about the lower end of cement plug 28 engages an upwardly facing shoulder 52 on the upper end of the float collar 12 to form a seal between them so that additional pressure will rupture the diaphragm 38 to permit cement to be circulated past the check valve 22 and into the annulus. The weight of the plug and force from its being pumped down the casing string 10 causes right-hand rotation of the cement plug 28 as the inclined plane J-slots on the cement plug 44 and the inclined plane J-slots on the float collar 46 to make up with one another in order to securely lock the shoulder 50 on the plug down on the shoulder 52 of the float collar.

As shown in FIG. 3, a wiper or upper plug 54, has been lowered from the position of FIG. 2 to seat on the upper end of the cement plug 28. As shown, the wiper plug 54 includes a body 56 and an elastomeric sleeve 58 about the body having lips or wings thereabout flexibly engagable with the inner diameter of the casing string 10 to permit the wiper plug 54 to be pumped downwardly onto the cement plug 28. As compared with the body of the cement plug 30, the body of wiper plug 56 is imperforate and thus does not permit flow through it.

The upper end of the body 30 of the cement plug is attachable to a third anti-rotational locking member 59. The lower end of the body 56 of the wiper plug is attachable to a fourth anti-rotational locking member 60. The anti-rotational locking members 59, 60 of the wiper plug and the upper cement plug are similar, and in the preferred embodiment are identical, to the first anti-rotational locking member 40 of the lower cement plug, the form of which is demonstrated in FIG. 5. Therefore, each anti-rotational locking member 59, 60 is composed of a cylinder 61, 62 having one or more inclined-plane J-slots 63, 64 about its circumference. The inclined-plane J-slots 64 of the wiper are disposed so as to have the ability to make up with the inclined-plane J-slots 63 on the cement plug when a vertical force, such as the weight of the wiper plug and a pumping force, is applied to the wiper plug 54 to push it towards the cement plug 28. The vertical force causes right-handed rotation between the plugs 28, 54 so that they make up. Thus, with the inclined-plane J-slots 63, 64 so engaged, both plugs 28, 54 are prevented from rotational and vertical movement with respect to one another and with respect to the float collar 12.

Preferably, the anti-rotational locking members 40, 48, 59, 60 are identical. In this way, several commercial manufacturing advantages may be realized. In the alternative, it would be preferred for the second anti-rotational locking member 48 of the float collar to be attachable also with the fourth anti-rotational locking member 60 of the wiper plug. In this way, the invention could be used without the cement plug 28, reducing the inventory an operator must maintain.

The over-all operation involving the use of the above-described interlocking float collar 12, cement plug 28 and wiper plug 54 is as follows: With the float collar 12 installed in the casing string 10, the cement plug 28 would be lowered through the casing string 10 onto the upper end of the float collar 12. As previously described, the cement plug 28 is so lowered by means of a column of cement within the casing string above it. During this time, of course, downward movement of the cement plug will force drilling mud in the casing string 10 downwardly past the check valve 22 and thus into the well bore beneath the casing string 10 and upwardly into the annulus from which it may be removed in the wellhead. More particularly, the wiper plug 54 is installed in the casing string 10 above the column of cement in the casing string 10 so as to permit it to be moved downwardly by the pressure of drilling fluid above it. As this pressure is increased, the diaphragm 38 is ruptured to permit the cement in the column to be circulated past the check valve 22 in the float collar 12 and up into the annulus between the casing string 10 and the well bore. When the cement column has been so circulated, the lower end of the wiper plug 54 lands upon the upper end of the cement plug 28, following which, at a later time, a drill string having a bit at its lower end is lowered into the casing string 10 into engagement with the upper end of the wiper plug 54. Thus, as well-known in the art, the cement column and inner body 16 of the float collar, as well as the bodies 30, 56 of the cement and wiper plugs, are made of a drillable material so that rotation of the drill string will permit the bit to drill them out and thus provide a full opening through the casing string 10. Once the anti-rotational locking members 40, 48, 59, 60 make up, rotation and vertical movement is inhibited among the float collar 12, the cement plug 28 and the wiper plug 54.

From the foregoing, it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

Many possible embodiments may be made of the invention without departing from the scope thereof. Therefore, it is to be understood that all matter herein set forth or shown in the accompanying drawings is to be interpreted as illustrative and not in a limiting sense.

What is claimed is:

1. An anti-rotational locking assembly for use between pieces of equipment in a casing string within a well bore, said anti-rotational locking assembly comprising:

a first anti-rotational locking member including a cylinder having a lockable end and an attachable end, the attachable end being attachable to a first piece of equipment, the lockable end having one or more inclined plane J-slots positioned about the circumference of the cylinder;

a second anti-rotational locking member including a cylinder having a lockable end and an attachable end, the attachable end attachable to a second piece of equipment, the lockable end having one or more inclined plane J-slots positioned about the circumference of the cylinder, wherein the lockable end of the first anti-rotational locking member is complimentary and connectable to the locking end of the second anti-rotational locking member such that the rotational and vertical movement between the first piece of equipment and the second piece of equipment is inhibited.

2. The assembly of claim 1, wherein the first and second anti-rotational members are of the same construction and dimensions.

3. An assembly for use in a casing string within a well bore, said assembly comprising:

a float collar, said float collar including a cylindrical outer body connectable to a casing string, an inner body, a first anti-rotational locking member attached to said inner body, said first anti-rotational locking member having a cylinder having a lockable end and an attachable end, the attachable end attachable to the inner body of the float collar, and the lockable end having one or more inclined plane J-slots positioned about the circumference of the cylinder and extending from said lockable end of said cylinder above the cylinder;

a cement plug having a cylindrical body, a flexible wiper disposed about the circumference of said body, a second anti-rotational locking member attached to said body, said second anti-rotational locking member having a cylinder having a lockable end and an attachable end, the attachable end attachable to the body of the cement plug, and the lockable end having one or more inclined plane J-slots positioned about the circumference of the cylinder and extending from said lockable end of said cylinder below the cylinder; and a third anti-rotational locking member attached to said body, said third anti-rotational locking member having a cylinder having a lockable end and an attachable end, the attachable end attachable to the cylindrical body of the cement plug, and the lockable end having one or more inclined plane J-slots positioned about the circumference of the cylinder and extending from said lockable end of said cylinder above the cylinder; and a wiper plug having a cylindrical body, a flexible wiper disposed about the circumference of said body, a fourth anti-rotational locking member attached to said body, said fourth anti-rotational locking member having a cylinder having a lockable end and an attachable end, the attachable end attachable to the cylindrical body of the wiper plug, and the lockable end having one or more inclined plane J-slots positioned about the circumference of the cylinder and extending from said lockable end of said cylinder below the cylinder;

wherein the slotted end of the first anti-rotational locking member is connectable to the slotted end of the second anti-rotational locking member such that rotational and vertical movement between the float collar and the cement plug is inhibited, and wherein the slotted end of the third anti-rotational locking member is connectable to the slotted end of the fourth anti-rotational locking member such that rotational and vertical movement between the cement plug and the wiper plug is inhibited.

4. An assembly as described in claim 3, wherein:

said float collar inner body is drillable;

said cement plug is drillable; and said wiper plug is drillable.

5. The assembly of claim 3, wherein:

the first, second, and third anti-rotational locking members are of the same construction and dimensions.

6. The assembly of claim 3, wherein:

the first, second, third, and fourth anti-rotational locking members are of the same construction and dimensions.

7. The assembly of claim 3, wherein:

the cement plug body has a circumferential shoulder engagable with a circumferential seat on the float collar such that when the first anti-rotational locking member is fully engaged with the second anti-rotational locking member, said circumferential shoulder and said circumferential seat form a seal between them external to the first anti-rotational locking member and second anti-rotational locking member; and the wiper plug body has a circumferential shoulder engagable with a circumferential seat on the inner body of the cement plug such that when the third anti-rotational locking member is fully engaged to the fourth anti-rotational locking member, said circumferential shoulder and said circumferential seat form a seal between them external to the third anti-rotational locking member and the fourth anti-rotational locking member.

8. The assembly of claim 3, wherein:

the first anti-rotational locking member is engagable with the fourth anti-rotational locking member.

9. The assembly of claim 7, wherein:

the first anti-rotational locking member and the circumferential shoulder on the wiper plug is engagable with the fourth anti-rotational locking member and the circumferential seat on the float collar.

10. An assembly for use in a casing string within a well bore, said assembly comprising:

a float collar having a cylindrical outer body connectable to the casing string and an inner body having a top end, a bottom end, and a bore extending therethrough from the top end to the bottom end;

a valve connected within the bore to permit flow downwardly and prevent flow upwardly therethrough;

a first anti-rotational locking member attached to the top end of said inner body, said first anti-rotational locking member having a cylinder having a lockable end and an attachable end, the attachable end attachable to the top end of the inner body of the float collar, and the lockable end having one or more inclined plane J-slots positioned about the circumference of the cylinder;

a cement plug having a cylindrical body having a top end, a bottom end, and a bore extending therethrough from the top end to the bottom end, the bore blocked by a frangible membrane, a flexible wiper disposed about the circumference of said body, a second anti-rotational locking member attached to the top end of said body, said second anti-rotational locking member having a cylinder having a lockable end and an attachable end, the attachable end attachable to the top end of the cement plug, and the lockable end having one or more inclined plane J-slots positioned about the circumference of the cylinder; and a third anti-rotational locking member attached to the bottom end of said body, said third anti-rotational locking member having a cylinder having a lockable end and an attachable end, the attachable end attachable to the bottom end of the cylindrical body of the cement plug, and the lockable end having one or more inclined plane J-slots positioned about the circumference of the cylinder and extending below the cylinder; and a wiper plug having a cylindrical body, a top end, a bottom end, and a flexible wiper disposed about the circumference of said body, a fourth anti-rotational locking member attached to the bottom end of said body, said fourth anti-rotational locking member having a cylinder having a lockable end and an attachable end, the attachable end attachable to the bottom end of the cylindrical body of the wiper plug, and the lockable end having one or more inclined plane J-slots positioned about the circumference of the cylinder;

wherein the slotted end of the first anti-rotational locking member is connectable to the slotted end of the second anti-rotational locking member such that rotational and vertical movement between the float collar and the cement plug is inhibited and wherein the slotted end of the third anti-rotational locking member is connectable to the slotted end of the fourth anti-rotational locking member such that rotational and vertical movement between the cement plug and the wiper plug is inhibited.

11. An assembly as described in claim 10, wherein:

said float collar inner body is drillable;

said cement plug body is drillable; and said wiper plug body is drillable.

12. The assembly of claim 10, wherein the first, second, and third anti-rotational locking members are of the same construction and dimensions.

13. The assembly of claim 10, wherein the first, second, third, and fourth anti-rotational locking members are of the same construction and dimensions.

14. The assembly of claim 10, wherein:

the body of the cement plug has a circumferential shoulder engagable with a circumfrerential seat on the float collar such that when the first anti-rotational locking member is fully engaged with the second anti-rotational locking member, said circumferential shoulder and said circumferential seat form a seal between them external to the first anti-rotational locking member and second anti-rotational locking member; and the body of the wiper plug has a circumferential shoulder engagable with a circumferential seat on the inner body of the cement plug such that when the third anti-rotational locking member is fully engaged to the fourth anti-rotational locking member, said circumferential shoulder and said circumferential seat form a seal between them external to the third anti-rotational locking member and the fourth anti-rotational locking member.

15. The assembly of claim 10, wherein the first anti-rotational locking member is engagable with the fourth anti-rotational locking member.

16. An assembly as described in claim 14, wherein the first anti-rotational locking member and the circumferential shoulder on the wiper plug is engagable with the fourth anti-rotational locking member and the circumferential seat on the float collar.

* * * * *

UNITED STATES PATENT AND TRADEMARK OFFICE

CERTIFICATE OF CORRECTION

PATENT NO. : 5,842,517

DATED : May 2, 1997

INVENTOR(S) : Malcolm G. Coone

It is certified that error appears in the above-identified patent and that said Letters Patent is hereby corrected as shown below:

On the cover page of the issued patent, 5th item in the left-hand column with "[22]" next to the field "Filed":

delete "May 5, 1997" and substitute therefor - - May 2, 1997 - -

Signed and Sealed this

Twentieth Day of April, 1999

*Attest:*

Q. TODD DICKINSON

*Attesting Officer*

*Acting Commissioner of Patents and Trademarks*